US006536769B1

(12) United States Patent
Palacios et al.

(10) Patent No.: US 6,536,769 B1
(45) Date of Patent: Mar. 25, 2003

(54) CARD GAME

(75) Inventors: Steven Palacios, Palmdale, CA (US); James Stillwell, Palmdale, CA (US)

(73) Assignee: Girardi Financial, Bell Gardens, CA (US)

( * ) Notice: Subject to any disclaimer, the term of this patent is extended or adjusted under 35 U.S.C. 154(b) by 0 days.

(21) Appl. No.: 10/003,449

(22) Filed: Oct. 23, 2001

(51) Int. Cl.[7] ..... A63F 1/00

(52) U.S. Cl. ..... 273/292; 273/274; 273/309; 273/236

(58) Field of Search ..... 273/292, 236, 273/274, 309

(56) References Cited

U.S. PATENT DOCUMENTS 5,013,049 A * 5/1991 Tomaszewski ..... 273/292
5,257,789 A * 11/1993 LeVasseur ..... 273/309
5,265,877 A * 11/1993 Boylan et al. ..... 273/139
5,275,415 A * 1/1994 Wisted ..... 273/274
5,397,128 A * 3/1995 Hesse et al. ..... 273/292
5,407,208 A * 4/1995 Keller et al. ..... 273/274
5,496,038 A * 3/1996 Kangsanaraks ..... 273/292
5,518,249 A * 5/1996 Sines et al. ..... 273/304
5,529,309 A * 6/1996 Bartlett ..... 273/292
5,613,682 A * 3/1997 Otuzbiryan ..... 273/292
5,653,445 A * 8/1997 Quach ..... 273/292
5,713,574 A * 2/1998 Hughes ..... 273/292
5,810,360 A * 9/1998 Srichayaporn ..... 273/292
5,823,536 A * 10/1998 Flasch ..... 273/292
5,944,314 A * 8/1999 Stavinsky ..... 273/292
5,961,119 A * 10/1999 Brown ..... 273/292
6,003,870 A * 12/1999 Johnson ..... 273/306
6,102,403 A * 8/2000 Kaufman ..... 273/292
6,170,828 B1 * 1/2001 Mostashari ..... 273/292
6,406,020 B1 * 6/2002 Reed ..... 273/274
6,446,972 B1 * 9/2002 Brunelle ..... 273/292
6,474,644 B1 * 11/2002 Pickle et al. ..... 273/274

* cited by examiner

*Primary Examiner*—Benjamin H. Layno
*Assistant Examiner*—D Collins
(74) *Attorney, Agent, or Firm*—James G. O'Neill

(57) ABSTRACT

A card game and the method of playing the game are carried out by providing 44 decks stripped of all cards except aces, deuces and treys. A selected dealer deals three cards to each player, face down, and the player may replace one of the cards after review. Betting units are awarded for three of a kind, suited or non-suited, and suited in sequential order. Players who do not have the requisite cards for such an award may remain in the game and the dealer turns over an action card, three times in a row, if necessary. Each player who has remained in the game may discard a matching card or cards and when a player discards all of his cards, he is declared the winner and entitled to the proceeds in a wager pot in which betting units have been accumulated at various stages of the game.

15 Claims, 1 Drawing Sheet

CARD GAME

BACKGROUND OF THE INVENTION

This invention relates to a card game and method of playing the same such as would be played at a casino using a special deck of cards and a minimum of equipment.

Various prior art card games used in gaming casinos are relatively complicated and require knowledge of the odds beyond that of an unskilled person player.

Blackjack or twenty-one is one example of such a game, where a player must make decisions as to whether to draw additional cards. Also, a widely played casino game, baccarat or chemin de fer, requires counting and the rules for drawing of cards is complicated and controlled by the dealer, rather than the player.

Applicant is also aware of casino card games protected by U.S. Pat. Nos. 4,659,087 and 5,275,415. In U.S. Pat. No. 4,659,087, the game requires players to maintain two pairs of cards while playing, as well as requiring the dealer to play, who usually is the bank. Such play is entirely different than the present invention.

In U.S. Pat. No. 5,275,415, a card game is disclosed wherein each player makes a wager or wagers and then is dealt two face "down" cards. Each player may look at the face "down" cards and consider whether the total count makes 22 or less. If it makes 22, that person is automatically a winner and stands pat. If less than 22, the player may receive "hits" in the form of additional "up" cards until 22 is reached or exceeded or the total is less than 22 but considered sufficient by the player to "stand on". This game is similar to blackjack but also different than that of the present invention.

SUMMARY OF THE INVENTION

The card game of the present invention is played with a special deck of cards consisting only of aces, deuces and treys in each of the four suits. Preferably the deck is comprised of 44 stripped standard decks of fifty-two cards. Each player receives three cards from a dealer after he "antes" into a pot called the "Tops" and can stand pat, or discard and draw one new card. Any player who has three of a kind suited (i.e., of the same suit), three of a kind non-suited (i.e., of two or more suits), or sequentially suited cards is paid a proportional betting unit based on odds, by all other players. Players who do not have one of the designated hands described will remain in the game. The dealer will then draw and turn up an additional card ("the action card"). Any player who has a card that matches the action card will receive one betting unit, or if two match, two betting units, from each player. The matching cards are discarded. The dealer will deal three action cards only. The first player to eliminate all of their cards gets paid as stated and additionally receives the Tops or ante. If no player is able to eliminate all their cards, the Tops will be awarded to the player with the fewest cards or split among the players tied with the fewest cards.

BRIEF DESCRIPTION OF THE DRAWINGS

Further objects and advantages of the invention will become more apparent from the following description and claims and from the accompanying drawings, wherein:

DETAILED DESCRIPTION OF THE PREFERRED EMBODIMENT

Figure 1:
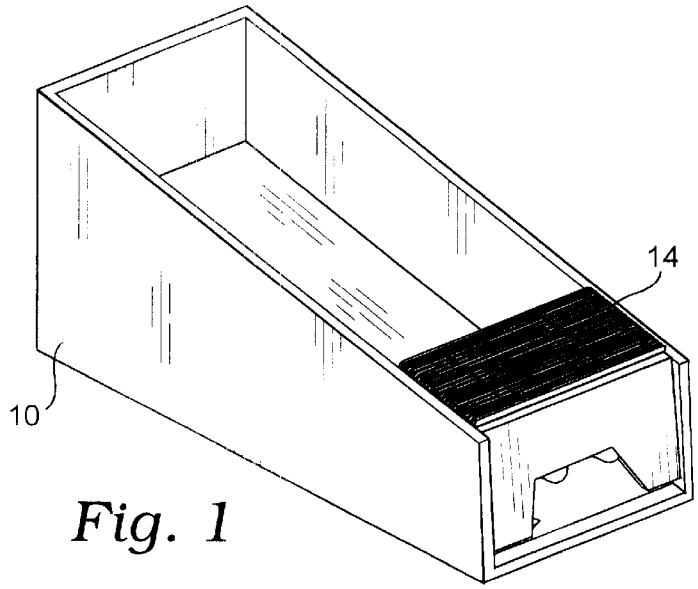
FIG. 1 is a perspective view of a shoe used to deal the cards of the deck used in the present invention.
Figure 2:
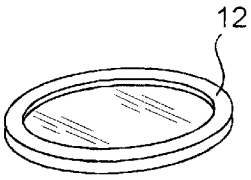
FIG. 2 is a perspective view of the dealer's identification button used to identify where the dealer starts to deal during play of the present invention.
Figure 3:
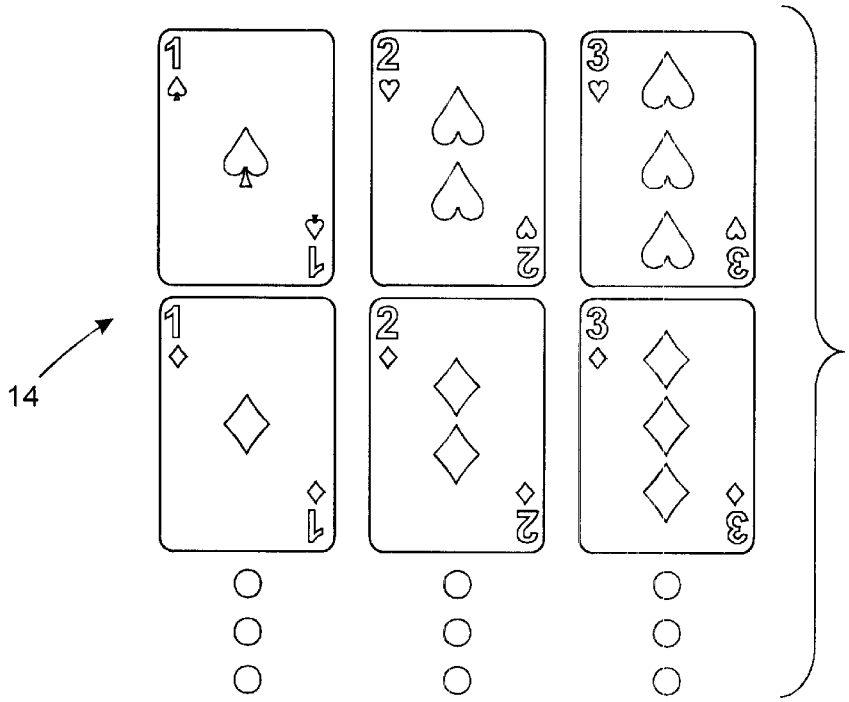
FIG. 3 is a front view of exemplary cards of the deck provided to play the card game of the present invention.

There are but three components or pieces of equipment that are needed to play the card game of the present invention: (1) a standard dealer's shoe 10 to hold at least 528 cards, (2) a disk or button 12 placed adjacent one of the players for determining where the first card will be dealt by a dealer, and (3) a deck 14 of 528 cards consisting of 44 standard card decks (of 52 cards) from which all cards that are 4 or higher in value have been stripped or removed, leaving only the aces, deuces and treys of each of the standard 4 suits. More particularly, each shoe 10 will consist of the following cards in deck 14:

44 Ace of Clubs 44 Two of Clubs 44 Three of Clubs

44 Ace of Spades 44 Two of Spades 44 Three of Spades

44 Ace of Hearts 44 Two of Hearts 44 Three of Hearts

44 Ace of Diamonds 44 Two of Diamonds 44 Three of Diamonds

The object of the game is to eliminate as many, or all of the cards in a player's hand. Cards can be eliminated as described in the rules of the game relating to play, as set out below:

Rules Of Play

The game will be played with two to five players. The game utilizes a dealer button, which is placed by a player to indicate where a dealer will start the dealing and which is moved from player to player in a clockwise direction at the conclusion of each hand. The order of play will also move in a clockwise direction starting with the player seated to the immediate left of the player with the dealer button.

All players who wish to participate in a hand begin by paying an ante or wager into a designated location; this pool of antes or wagers is referred to as the "Tops".

The dealer, dealing from a shoe, will deal one card at a time to each player. The dealing will begin with the player seated to the left of the player with the dealer button. Cards are dealt face down. Each player receives three cards.

Players will review their cards and determine if they want to play the hand or fold. If the player folds, he discards his cards. Players wishing to continue to play will wager one betting unit into the Tops. Players choosing to continue have the choice to play with the three cards they were originally dealt or to discard one card and receive a new card from the shoe. If a player wants a new card, he will discard a card, face down and the dealer will burn a card and then deal a card face down to that player. Each player can exercise this option one time per hand or game. Once all players have exercised this option, players will open their hands by placing their cards face up on the table in front of them.

At this time, any player who has three of a kind suited, three of a kind non-suited, or sequentially suited cards will be paid as follows:

Three of a kind suited treys, pays 6 betting units

Three of a kind suited deuces, pays 4 betting units

Three of a kind suited aces, pays 2 betting units

Three of a kind unsuited treys, pays 3 betting units

Three of a kind unsuited deuces, pays 2 betting units

Three of a kind unsuited aces, pays 1 betting unit

Suited sequential cards pays 1 betting unit, and

Spades always pays double.

All players who have a group of cards as defined above will be paid the stated betting units by all other players. The pay off will begin with the player seated to the immediate left of the player with the dealer button.

Players who do not have one of the hands described above will remain in the game. The dealer will then burn one card and then turn one card face up. This is the action card. Any player who has a card that matches the action card will receive one betting unit from each of the other players. If a player has two matching cards, they will receive two betting units. Again, the pay out will begin with the first player seated to the left of the dealer button and still in action. Once a player has been paid for a matching card, that card is discarded. Again, spades always pay double. This process will repeat two more times. The dealer will deal three action cards only.

The first person to eliminate all of their cards gets paid as stated above and receives the Tops. If two or more people are able to eliminate all of their cards, the Tops will be divided equally among those players. If no player is able to eliminate all of their cards, the Tops will be awarded to the person with the fewest cards or split among the players with the fewest cards.

After the dealer has dealt the third and final action card and the pay offs completed, the hand is over, and the dealer button rotates to the next player in a clockwise direction and the whole process begins again.

The invention and its attendant advantages will be understood from the foregoing description and it will be apparent that various changes may be made in form, construction and arrangements of the components without departing from the spirit and scope thereof. We do not wish to be restricted to the specific forms shown or uses mentioned, except as defined in the accompanying claims.

We claim:

1. A method of playing a card game among a plurality of players playing against each other with the ultimate objective of having no remaining dealt cards including the steps of:

providing a deck of at least 528 cards having 44 aces, deuces and treys of clubs, spades, hearts and diamond suits;

providing a dealer for dealing a number of the cards individually from the deck to each of the players;

dealing by the dealer of three cards to each of the plurality of players face down who review their dealt cards in order to determine whether to continue to play;

determining by each of the plurality of players who continue whether to be dealt a replacement card for one of the three held and originally dealt;

turning over the dealt cards, face up, in front of each of the plurality of players who continue; and paying one or more betting units by each of the plurality of players who continue to another of the players who continue as an award for a predetermined three of a kind cards, suited or unsuited, and suited sequential cards.

2. A method of playing a card game in accordance with claim 1 including the additional steps of:

each of the plurality of players placing wagers in a designed location prior to dealing of the cards by the dealer, and when the plurality of players desire to continue to play after the initial dealing of the cards, placing additional wagers in the designated location by each of the players who continue; and continuing the game by the players who continue by competing for the wagers placed in the designated location by eliminating cards from each of the players who continue and who match an additional card dealt face up by the dealer, until three or less cards have been dealt, wherein at least one of the players who continue with the least amount of cards, or first to discard all their cards, receives the wagers placed in the designated location.

3. A method of playing a card game in accordance with claim 2 wherein one or more betting units are paid by each of the players who continue to at least one of the players who continue having a match of an additional card.

4. A method of playing a card game in accordance with claim 3 wherein if two or more of the players who continue have the same number of cards remaining after a third additional card is dealt face up during the discard phase of the game, the wagers in the predetermined location are split equally between the two or more of the players who continue.

5. A method of playing a card game in accordance with claim 4 wherein the first card is dealt to one of the plurality of players who is to the left of a dealer button, which dealer button is systematically moved around the table in a clockwise direction after each game is concluded.

6. A method of playing a card game in accordance with claim 4 including the step of providing a dealer button to indicate where the dealing starts.

7. A method of playing a card game in accordance with claim 3 wherein each betting unit paid by the players who continue is doubled for suited cards 3 of which are spades.

8. A method of playing a card game among a plurality of players playing against each other with the ultimate objective of having no remaining dealt cards including the steps of:

providing a deck of 528 cards having only aces, deuces and treys of clubs, spades, hearts and diamonds;

providing a dealer for dealing a number of the cards individually from the deck to each of the plurality of players;

placing a required wager by each of the plurality of players in a designated location prior to dealing of the cards by the dealer;

dealing by the dealer of three cards to each of the plurality of players face down, whereby the plurality of players may review their three dealt cards in order to determine whether to continue to play;

determining by each of the plurality of players who continue to play whether to be dealt a replacement card for one of the three dealt cards;

turning over the three dealt cards, face up, in front of each of the plurality of players who continue to play; and paying one or more betting units by each of the plurality of players who continue to play to another of the plurality of players who continue to play having a predetermined three of a kind cards, suited or unsuited, and suited sequential cards.

9. The method of claim 8, including the further step of continuing the game by those players not receiving payment for a predetermined three of a kind cards, suited or non-suited, and suited sequential cards, by competing for the wagers placed in the designated location by eliminating cards from each of the plurality of players who continue, which matches an additional card dealt face up by the dealer, until three or less additional cards have been dealt, wherein a remaining player with the least amount of cards or first to discard all their cards receives the wagers placed in the designated location.

10. The method of claim 9 wherein one or more betting units are paid by each of the plurality of players who continue to play to a player having a match of a discarded card; and if two or more players have the same number of cards remaining after the third additional card is dealt face up during the discard phase of the game, the wagers in the predetermined location are split equally between the two or more players.

11. The method of claim 9 wherein the first card is dealt to one of the plurality of players who is to the left of a button, which button is systematically moved around the table in a clockwise direction after each game is concluded.

12. The method of claim 9, including the step of providing an identification device to indicate where a dealer starts dealing each game.

13. The method of claim 10 wherein each of the betting units paid by the plurality of players who continue to play is doubled for suited cards 3 of which are spades.

14. A method of playing a card game among a plurality of players playing against each other with the ultimate objective of having no remaining dealt cards including the steps of:

providing a deck of at least 528 cards having only aces, deuces and treys of clubs, spades, hearts and diamonds;

providing a dealer for dealing a number of the cards individually from the deck to each of the plurality of players;

placing a required wager by each of the plurality of players in a designated location prior to dealing of the cards by the dealer;

providing a button adjacent one of the players to indicate that dealing of the cards starts at a player to the left of the button;

dealing by the dealer of three cards to each of the plurality of players face down, whereby the plurality of players may review their three dealt cards in order to determine whether to continue to play;

determining by each of the plurality of players who continue to play whether to be dealt a replacement card for one of the three dealt cards;

turning over the three dealt cards, face up, in front of each of the plurality of players who continue to play;

paying one or more betting units by each of the plurality of players who continue to play to another of the plurality of players who continue to play having a predetermined three of a kind cards, suited or unsuited, and suited sequential cards;

continuing the game by having the dealer deal up to three additional cards, face up;

allowing the additional cards to be matched by the plurality of players who continue to play, so as to allow the plurality of players who continue to play to discard matched cards and to be paid one or more betting units by the other players who continue to play, for each discarded card; and paying a remaining player with the least cards the wagers placed in the designated location.

15. The method of claim 14 wherein each of the betting units paid by the plurality of players who continue to play is doubled for suited cards, 3 of which are spades.

* * * * *